US008858186B2

(12) United States Patent
Kim et al.

(10) Patent No.: US 8,858,186 B2
(45) Date of Patent: Oct. 14, 2014

(54) LINEAR COMPRESSOR

(75) Inventors: Jong-Kwon Kim, Changwon-shi (KR); Shin-Hyun Park, Pusan (KR); Kye-Lyong Kang, Gyeongsangnam-do (KR); Hee-Dong Kang, Changwon-shi (KR); Jeong-Uk Lee, Jeonju-shi (KR); Hyun Kim, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 796 days.

(21) Appl. No.: 12/992,030

(22) PCT Filed: Jul. 22, 2009

(86) PCT No.: PCT/KR2009/004068

§ 371 (c)(1),
(2), (4) Date: Nov. 10, 2010

(87) PCT Pub. No.: WO2010/011085

PCT Pub. Date: Jan. 28, 2010

(65) Prior Publication Data

US 2011/0061411 A1 Mar. 17, 2011

(30) Foreign Application Priority Data

Jul. 22, 2008 (KR) ..... 10-2008-0071378

(51) Int. Cl.

| | |
|---|---|
| ***F04B 49/06*** | (2006.01) |
| ***F04B 17/04*** | (2006.01) |
| ***F04B 35/04*** | (2006.01) |
| ***F25B 49/02*** | (2006.01) |
| ***F25B 1/02*** | (2006.01) |
| ***F04B 53/08*** | (2006.01) |

(52) U.S. Cl.

CPC ..... *F04B 35/045* (2013.01); *F25B 49/025* (2013.01); *F25B 2400/073* (2013.01); *F25B 1/02* (2013.01); *F04B 53/08* (2013.01)

USPC ..... 417/45; 417/417

(58) Field of Classification Search

CPC ..... F04B 53/08; F04B 49/025; F25B 1/02; F25B 35/045; F25B 2400/073

USPC ..... 417/44.1, 44.11, 415, 417, 45; 318/126; 62/228.1

See application file for complete search history.

(56) References Cited

U.S. PATENT DOCUMENTS 6,289,680 B1 * 9/2001 Oh et al. ..... 62/6
7,859,801 B2 * 12/2010 Roh et al. ..... 361/22

(Continued)

FOREIGN PATENT DOCUMENTS

KR 10-2007-0092027 9/2007
KR 1020070079514 B1 9/2007
WO WO 2007089083 A2 * 8/2007

*Primary Examiner* — Nathan Zollinger

(74) *Attorney, Agent, or Firm* — McKenna Long & Aldridge LLP

(57) ABSTRACT

The present invention relates to a linear compressor, and more particularly, to a linear compressor which supplies a necessary cooling capacity through a natural cooling capacity modulation and a forcible cooling capacity modulation, and a cooling system using the same. The linear compressor according to the present invention includes a compression space into which refrigerant is sucked, a movable member which linearly reciprocates to compress the refrigerant sucked into the compression space, one or more springs which are installed to elastically support the movable member in a motion direction of the movable member, a motor unit which includes a motor and a capacitor connected in series to the motor so as to make the movable member linearly reciprocate, and a motor control unit which performs a natural cooling capacity modulation according to a load by reciprocation of the movable member.

22 Claims, 11 Drawing Sheets

(56) References Cited

U.S. PATENT DOCUMENTS 8,197,220 B2 * 6/2012 Sung et al. ..... 417/44.11
2005/0031470 A1 2/2005 Lee
2007/0159128 A1 7/2007 Dainez et al.
2009/0206778 A1 * 8/2009 Roh et al. ..... 318/127

* cited by examiner

【Figure 13】
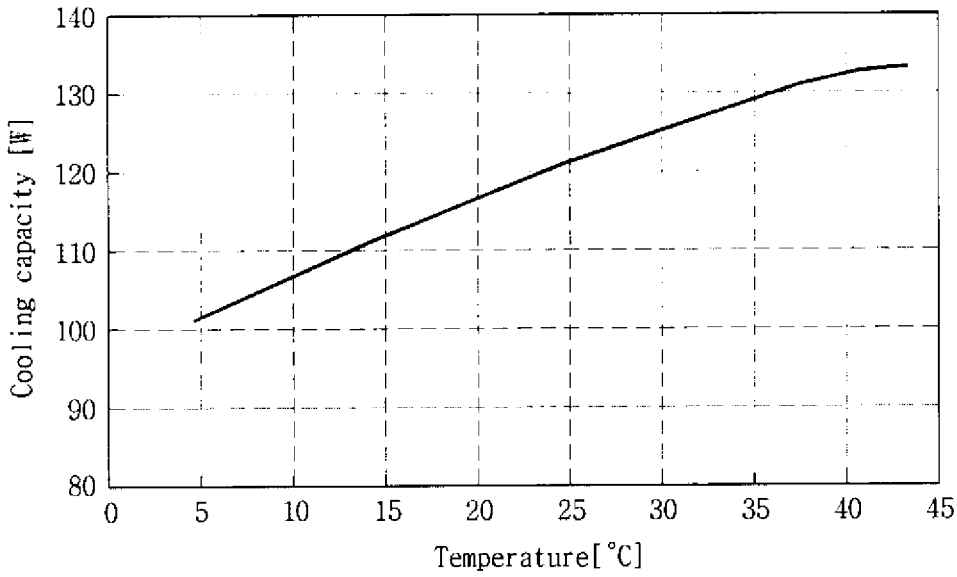
【Figure 14】
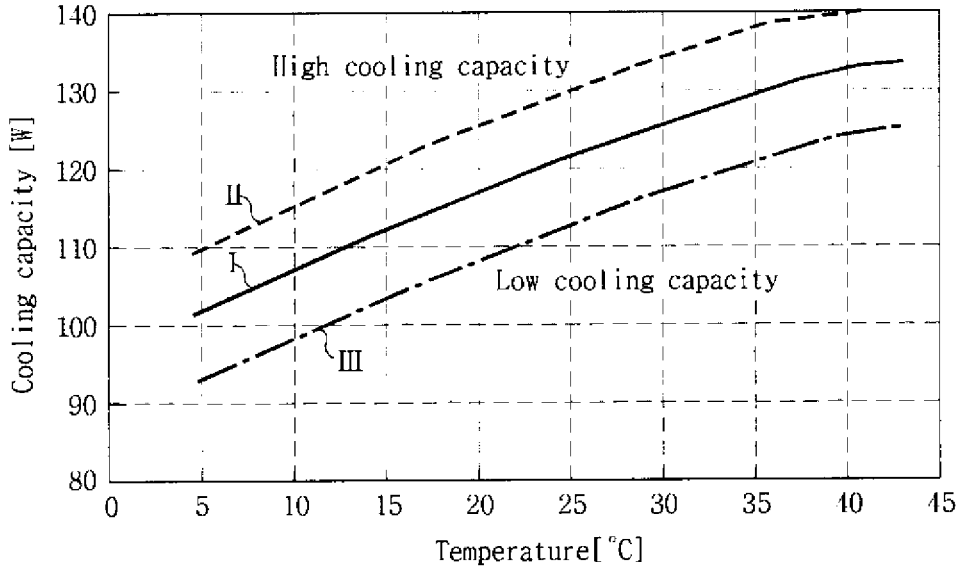

LINEAR COMPRESSOR

This application is a 35 U.S.C. §371 National Stage entry of International Application No. PCT/KR2009/004068, filed on Jul. 22, 2009, which claims the benefit of the earlier filing date and right of priority to Korean Application No. 10-2008-0071378, filed on Jul. 22, 2008, the content of which are hereby incorporated by reference herein in their entirety.

TECHNICAL FIELD

The present invention relates to a linear compressor, and more particularly, to a linear compressor which supplies a necessary cooling capacity through a natural cooling capacity modulation and a forcible cooling capacity modulation, and a cooling system using the same.

BACKGROUND ART

In general, a motor is provided in a compressor which is a mechanical apparatus receiving power from a power generation apparatus such as an electric motor, a turbine or the like, and compressing the air, refrigerant or various operation gases to raise a pressure. The compressor has been widely used for electric home appliances such as refrigerators and air conditioners, and application thereof has been expanded to the whole industry.

Particularly, the compressors are roughly classified into a reciprocating compressor, wherein a compression space to/from which an operation gas is sucked and discharged is defined between a piston and a cylinder, and the piston linearly reciprocates in the cylinder to compress refrigerant, a rotary compressor, wherein a compression space to/from which an operation gas is sucked and discharged is defined between an eccentrically-rotating roller and a cylinder, and the roller eccentrically rotates along an inner wall of the cylinder to compress refrigerant, and a scroll compressor, wherein a compression space to/from which an operation gas is sucked and discharged is defined between an orbiting scroll and a fixed scroll, and the orbiting scroll rotates along the fixed scroll to compress refrigerant.

Recently, among the reciprocating compressors, a linear compressor has been actively developed because it improves compression efficiency and provides simple construction by removing a mechanical loss caused by motion conversion by directly connecting a piston to a linearly-reciprocating driving motor.

FIG. 1 is a block diagram illustrating construction of a motor control apparatus applied to a conventional linear compressor.

As illustrated in FIG. 1, the motor control apparatus includes a rectification unit which is composed of a diode bridge 11 receiving input of AC power which is commercial power, and rectifying and outputting the resulting voltage, and a capacitor C1 smoothing the rectified voltage, an inverter unit 12 which receives a DC voltage, converts the DC voltage into an AC voltage according to a control signal from a control unit 17, and supplies the AC voltage to a motor unit, the motor unit which includes a motor 13 and a capacitor C2 connected in series to the motor 13, a voltage detection unit 14 which detects a both-end voltage of the capacitor C1, a current detection unit 15 which detects a current flowing through the motor unit, an operation unit 16 which operates a counter electromotive force (EMF) from the sensed voltage from the voltage detection unit 14 and the sensed current from the current detection unit 15, and the control unit 17 which generates a control signal, reflecting the counter EMF from the operation unit 16 and the sensed current from the current detection unit 15.

In the control apparatus, the operation unit 16 operates the counter EMF by the following Formula 1:

$$EMF = V - L\frac{di}{dt} - \frac{1}{C}\int i\,dt - Ri \qquad \text{(Formula 1)}$$

Here, L represents an inductance of the motor 13, V represents an applied voltage to the inverter unit 12, and R represents a resistance value of the motor 13.

That is, the operation unit 16 operates the counter EMF according to the sensed current from the current detection unit 15.

FIG. 2 is a graph showing cooling capacity modulations of the linear compressor of FIG. 1. The graph of FIG. 2 shows a control result of the control unit 17 for acquiring a necessary cooling capacity, when a BLDC inverter is applied to the inverter unit 12 of the motor control apparatus.

As a temperature which is a load rises, the control unit 17 controls the inverter unit 12 to forcibly raise an AC voltage applied to the motor 13, thereby acquiring a cooling capacity required for the load. As shown, when a temperature rises from 10□ to 50□, the control unit 17 performs four forcible voltage raising controls to thereby acquire a target cooling capacity or cooling capacity ratio.

However, when the control unit 17 acquires the cooling capacity through plural forcible voltage raising controls or forcible voltage dropping controls, the control unit 17 must perform plural controls. Reliability of components in the motor control apparatus is severely reduced due to continuous voltage modulations for the forcible voltage raising and dropping controls. In addition, a protection device (protection circuit) should be additionally provided against the plural voltage modulations.

DISCLOSURE

Technical Problem

An object of the present invention is to provide a linear compressor which performs a natural cooling capacity modulation control according to a load, and selectively performs a forcible cooling capacity modulation control by a power control as needed, to simplify a cooling control process, and a cooling system using the same.

Another object of the present invention is to provide a linear compressor which performs a natural cooling capacity modulation control to reduce a power shock of components and simplify the components, and a cooling system using the same.

A further object of the present invention is to provide a linear compressor which is connected to one or more cooling apparatuses and used in a small number to supply a necessary cooling capacity to the cooling apparatuses by a simple control, particularly, when a deviation of necessary cooling capacities is great, and a cooling system using the same.

A still further object of the present invention is to provide a motor control apparatus which does not use a current value but a voltage value when calculating a counter EMF, and a linear compressor using the same.

A still further object of the present invention is to provide a motor control apparatus which improves accuracy of voltage sensing, and a linear compressor using the same.

A still further object of the present invention is to provide a linear compressor which uses a motor control apparatus to apply a substantially-fixed voltage and a voltage having a frequency characteristic, or a varied voltage and a voltage having a frequency characteristic to a motor.

A still further object of the present invention is to provide a linear compressor which uses a motor control apparatus to apply an output of a constant voltage and a constant frequency to a motor, even if external power varies.

Technical Solution

According to an aspect of the present invention, a linear compressor includes a compression space into which refrigerant is sucked, a movable member which linearly reciprocates to compress the refrigerant sucked into the compression space, one or more springs which are installed to elastically support the movable member in a motion direction of the movable member, a motor unit which includes a motor and a capacitor connected in series to the motor so as to make the movable member linearly reciprocate, and a motor control unit which performs a natural cooling capacity modulation according to a load by reciprocation of the movable member.

In addition, preferably, the motor control unit performs the natural cooling capacity modulation by maintaining an amplitude and frequency of a voltage applied to the motor unit to be substantially constant.

According to another aspect of the present invention, a linear compressor includes a compression space into which refrigerant is sucked, a movable member which linearly reciprocates to compress the refrigerant sucked into the compression space, one or more springs which are installed to elastically support the movable member in a motion direction of the movable member, a motor unit which includes a motor and a capacitor connected in series to the motor so as to make the movable member linearly reciprocate, and a motor control unit which performs a natural cooling capacity modulation according to a refrigerant change by varying a stroke of the movable member.

In addition, preferably, the motor control unit senses a voltage corresponding to commercial power applied from the outside or power applied to the motor unit, and controls the motor unit according to the sensed voltage.

Moreover, preferably, the motor control unit performs a forcible cooling capacity modulation by varying an amplitude or frequency of a voltage applied to the motor unit.

Further, preferably, the motor control unit performs the forcible cooling capacity modulation by varying then amplitude or frequency of the voltage applied to the motor unit into plural values, and then performs the natural cooling capacity modulation by maintaining the amplitude or frequency of the varied voltage to be constant, and applying the maintained AC voltage to the motor unit.

Furthermore, preferably, the motor control unit varies the amplitude or frequency of the voltage according to a cooling capacity modulation command from a cooling control apparatus.

Still furthermore, preferably, the motor control unit includes a rectification unit which receives input of AC power and outputs a DC voltage, an inverter unit which receives the DC voltage, converts the DC voltage into an AC voltage according to a control signal, and supplies the AC voltage to the motor unit, a first voltage detection unit which senses a voltage applied to the inverter unit, a second voltage detection unit which senses a both-end voltage of the capacitor or a voltage corresponding to a voltage between the capacitor and the ground, and a control unit which receives a first voltage from the first voltage detection unit and a second voltage from the second voltage detection unit, generates a control signal for controlling the inverter unit to maintain an amplitude and frequency of the AC voltage to be substantially constant according to the first and second voltages, and applies the control signal to the inverter unit.

Still furthermore, preferably, the control unit regulates a sampling time of the second voltage detection unit which detects the second voltage.

Still furthermore, preferably, the control unit operates a counter EMF corresponding to the first and second voltages, and generates a control signal according to the operated counter EMF.

According to a further aspect of the present invention, a cooling system includes one or more cooling apparatuses, a compressor which is connected to the cooling apparatus to supply refrigerant thereto, and performs a natural cooling capacity modulation control for naturally modulating a cooling capacity according to a load, and a forcible cooling capacity modulation control for forcibly modulating a cooling capacity according to a load or a cooling control command so as to supply the refrigerant to the cooling apparatus, and a refrigerant tube which connects the cooling apparatus to the compressor.

According to a still further aspect of the present invention, a cooling system includes one or more cooling apparatuses, a compressor which is connected to the cooling apparatus to supply refrigerant thereto, and performs only a natural cooling capacity modulation control for naturally modulating a cooling capacity according to a load so as to supply the refrigerant to the cooling apparatus, and a refrigerant tube which connects the cooling apparatus to the compressor.

Advantageous Effects

According to the present invention, the linear compressor performs a natural cooling capacity modulation control according to a load, and selectively performs a forcible cooling capacity modulation control by a power control as needed, thereby simplifying a cooling control process, reducing applied power, and supplying a necessary cooling capacity.

In addition, according to the present invention, the linear compressor performs a natural cooling capacity modulation control to reduce a power shock of the components and simplify the components.

Moreover, according to the present invention, the linear compressor is connected to one or more cooling apparatuses and used in a small number to stably supply a necessary cooling capacity to the cooling apparatuses by a simple control, particularly, when a deviation of necessary cooling capacities is great.

Further, according to the present invention, in this construction, the motor control apparatus does not use a current value but a voltage value when operating a counter EMF, thereby accurately operating the counter EMF and precisely controlling the motor.

Furthermore, according to the present invention, the motor control apparatus applies a substantially-fixed voltage and a voltage having a frequency characteristic, or a varied voltage and a voltage having a frequency characteristic to the motor provided in the linear compressor, to modulate a cooling capacity according to a load.

Still furthermore, according to the present invention, the motor control apparatus applies an output of a substantially-constant voltage and frequency to the motor, even if external input power varies, which results in high reliability of the linear compressor.

DESCRIPTION OF DRAWINGS

FIGS. 13 to 16 are graphs showing cooling capacities of the linear compressor of FIG. 12;

MODE FOR INVENTION

Hereinafter, exemplary embodiments of the present invention which can accomplish the above objects will be described in detail with reference to the accompanying drawings.

Figure 3:
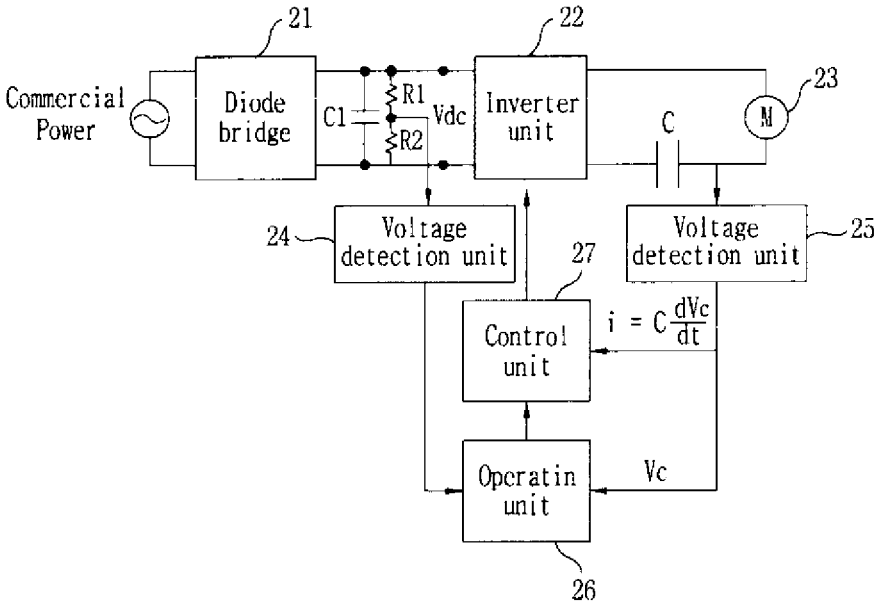
FIG. 3 is a block diagram illustrating construction of a motor control apparatus applied to a linear compressor according to the present invention.

FIG. 3 is a block diagram illustrating construction of a motor control apparatus applied to a linear compressor according to the present invention.

The motor control apparatus shown in FIG. 3 includes a rectification unit which is composed of a diode bridge 21 receiving input of AC power which is commercial power, and rectifying and outputting the resulting voltage, and a capacitor C1 smoothing the rectified voltage, an inverter unit 22 which receives a DC voltage, converts the DC voltage into an AC voltage according to a control signal from a control unit 27, and supplies the AC voltage to a motor unit, the motor unit which includes a motor 23 and a capacitor C connected in series to the motor 23, a voltage detection unit 24 which detects a both-end voltage of the capacitor C1 or a divided voltage of a voltage dividing resistor unit R1 and R2, a voltage detection unit 25 which detects a both-end voltage Vc of the capacitor C or a voltage V1 between the capacitor C and the ground, an operation unit 26 which calculates a counter EMF from the sensed voltage from the voltage detection unit 24 and the sensed voltage from the voltage detection unit 25, and the control unit 27 which generates a control signal, reflecting the counter EMF from the operation unit 26 and the sensed voltage from the voltage detection unit 25. In this description, a process for the control unit 27 generating the control signal according to the counter EMF and the sensed voltage will not be explained. Such a process can be clearly understood by a person of ordinary skill in the art.

In addition, the control unit 27 may be constructed as a single element or circuit with the operation unit 26.

First, the diode bridge 21 is an element which performs a general rectifying function, and the capacitor C1 is an element which smoothes a rectified voltage.

The voltage dividing resistor unit R1 and R2 is composed of at least two serially-connected resistors R1 and R2, and divides the rectified voltage from the diode bridge 21. Normally, since the rectified voltage of the diode bridge 21 ranges from a few hundreds to a few thousands V (e.g., 200 to 1000 V), application of such a large voltage may be excessive for the operation unit 26 and/or the control unit 27. It is thus necessary to divide the voltage. Preferably, a voltage of a defined amplitude (e.g., about 5 V or 0.2 V) is applied to the operation unit 26 and the control unit 27, and a resistance value of the resistor R1 is larger than that of the resistor R2 by at least a few hundreds to a few thousands times. The resistance values or resistance value ratio of the resistors R1 and R2 is recognized by the operation unit 26 and the control unit 27, so that it is possible to calculate or estimate an amplitude of a DC link voltage Vdc by the divided voltage.

That is, the operation unit 26 and the control unit 27 read the rectified voltage or some of the voltage from the diode rectification circuit 21.

Next, since the inverter unit 22, the motor unit and the voltage detection unit 24 are easily recognized by a person of ordinary skill in the art, explanations thereof are omitted.

The voltage detection unit 25 detects the both-end voltage of the capacitor C or the voltage between the capacitor C and the ground, particularly, some (i.e., the divided voltage) of the voltage between the capacitor C and the ground, and applies the detected voltage (or the sensed voltage) V2 to the operation unit 26 and the control unit 27. The voltage detection unit 25 will be described later in detail.

Next, the operation unit 26 calculates or operates the counter EMF from the voltage from the voltage detection unit 24 and the voltage V2 from the voltage detection unit 25. Such an operation is performed by the following Formulae. This mathematical operation can be implemented in a hardware or middleware manner and a software manner. This embodiment provides a case where the both-end voltage Vc of the capacitor C is detected.

$$Vc = \frac{1}{C}\int i\,dt \qquad \text{⟨Formula 2⟩}$$

Here, i represents a current flowing through the motor unit, and C represents a capacitance of the capacitor C. The voltage Vc of the capacitor C is converted from Formula 2 to Formula 3.

$$i = C\frac{dVc}{dt} \qquad \text{⟨Formula 3⟩}$$

When the voltage Vc of Formula 3 is introduced into Formula 1, the following formula 4 is obtained.

$$EMF = V - LC\frac{d}{dt}\frac{dVc}{dt} - Vc - RC\frac{dVc}{dt} \qquad \text{⟨Formula 4⟩}$$

Here, L represents an inductance of the motor 23, V represents an applied voltage Vdc to the inverter unit 22, and R represents a resistance value of the motor 23.

At this time, the voltage Vc can be defined as (1) of Formula 5, and a differential value of the voltage Vc can be defined as (2) of Formula 5. In addition, a double differential value of the voltage Vc can be defined as (3) of Formula 5.

⟨Formula 5⟩

$$Vc = Vc \cdot \max \times \cos(\omega_o t + \theta) \quad (1)$$

$$\frac{dVc}{dt} = -\omega_o Vc \cdot \max \times \sin(\omega_o t + \theta) \quad (2)$$

$$\frac{d^2 Vc}{dt^2} = -\omega_o^2 Vc \cdot \max \times \cos(\omega_o t + \theta) = -\omega_o^2 Vc \quad (3)$$

When the differential value and the double differential value of the voltage Vc are introduced into Formula 4 according to the definitions of Formula 5, the following Formula 6 is obtained.

Here, ω represents a motion frequency of the motor 23.

$$EMF = V - RC\frac{dVc}{dt} + LC\omega^2 Vc - Vc \quad \text{⟨Formula 6⟩}$$

Formula 6 is arranged as the following Formula 7.

$$EMF = V + (LC\omega^2 - 1)Vc - RC\frac{dVc}{dt} \quad \text{⟨Formula 7⟩}$$

Accordingly, the operation unit 26 and the control unit 27 can calculate or operate the counter EMF from the both-end voltage Vc of the capacitor C. Particularly, although a differential operation such as RCdVc/dt is required in Formula 7, this value is relatively considerably smaller than other values in the counter EMF operation, so that an influence from noise extremely decreases.

Moreover, since significance of the differential operation becomes very small in the counter EMF operation, even if accuracy of the differential operation is low, an influence on the counter EMF operation is small. Therefore, even if a processor (e.g., a microprocessor) provided in the operation unit 26 has relatively low performance, it can comparatively precisely perform the counter EMF operation.

Further, since the voltage of the capacitor C is not sharply changed in spite of a sharp change of an external current and noise, the value of the voltage Vc does not contain noise. Accordingly, the overall counter EMF operation is seldom affected by noise.

Furthermore, the control unit 27 can operate a speed by multiplying the counter EMF from the operation unit 26 by a specific constant, or operate a displacement (e.g., a displacement of a piston in a linear compressor) by integrating the speed.

Still furthermore, as publicly known, the control unit 27 generates a PWM signal and a control signal corresponding to the PWM signal, and controls the inverter unit 22 by the control signal. It is also widely known that the PWM signal can be calculated as a duty ratio through the relation with the voltage Vdc. In the case of a freezing cycle, the control unit 27 regulates a cooling capacity through the control signal and the duty ratio.

Figure 4:
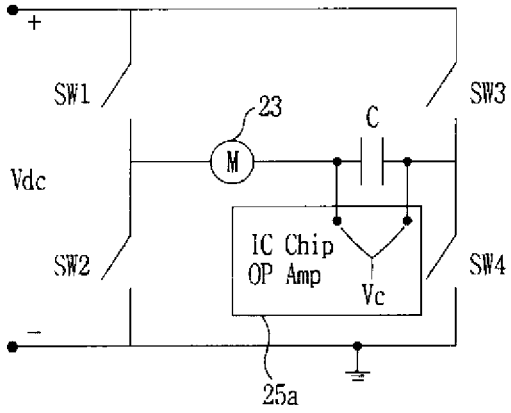
FIGS. 4 to 6 are circuit views illustrating first to third embodiments of a detection circuit of a voltage detection unit of FIG. 3.
Figure 5:
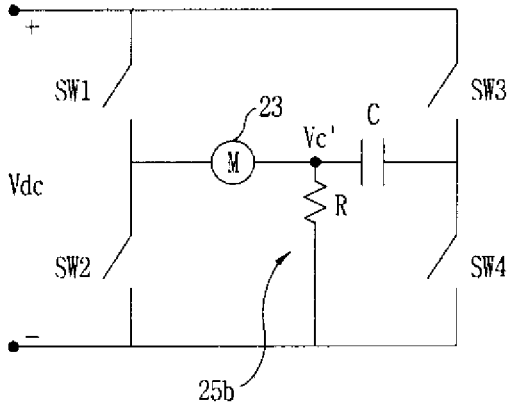
Figure 6:
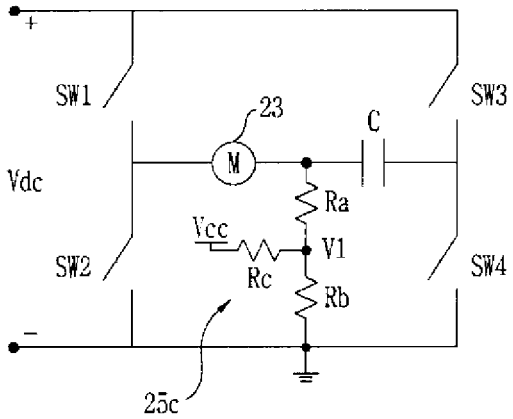

FIGS. 4 to 6 are circuit views illustrating first to third embodiments of a detection circuit of the voltage detection unit of FIG. 3.

FIG. 4 shows a construction for directly detecting the both-end voltage Vc of the capacitor C. A voltage detection unit 25*a* is formed of an IC chip OP amp, so that the voltage Vc can be detected through the general OP amp. The direct detection of the voltage Vc does not require a special software for operating a voltage.

The inverter unit 22 is composed of two pairs of switches SW1, SW2 and SW3, SW4 connected in series, and the motor unit is connected to between the switches SW1 and SW2 and to between the switches SW3 and SW4. Particularly, when the switch SW1 is on and the switch SW2 is off, the switch SW3 is off and the switch SW4 is on (hereinafter, referred to as 'first operation'). In addition, when the switch SW1 is off and the switch SW3 is on, the switch SW4 is off and the switch SW2 is on (hereinafter, referred to as 'second operation'). The operation of the inverter unit 22 is performed below in the same manner.

Moreover, the voltage detection unit 25*a* is applied with a DC reference voltage Vcc (e.g., +12 V and −12 V) for operation of the op amp, and thus offset by a certain voltage value.

FIGS. 5 and 6 show constructions for sensing a voltage to calculate a voltage approximate or identical to the voltage Vc by a low-priced resistor without using the OP amp of FIG. 4. A voltage Vc' corresponds to the voltage between the capacitor C and the ground. A voltage detection unit 25*b* is formed of a resistor R which connects the capacitor C to the ground.

In FIG. 5, when the inverter unit 22 performs the first operation, the voltage Vc' becomes identical to the both-end voltage Vc of the capacitor C, and when the inverter unit 22 performs the second operation, the voltage Vc' can be operated as (Vc=Vc'−Vdc). These operations are recognized when the voltage detection unit 25 includes the voltage detection unit 25*b* and a software or firmware operation means.

Unlike FIG. 5, in FIG. 6, a voltage dividing resistor unit 25*c* detects a divided voltage of the voltage Vc' of FIG. 5. The voltage dividing resistor unit 25*c* is composed of resistors Ra and Rb connected in series between the capacitor C and the ground, and a resistor Rc connecting a portion between the resistors Ra and Rb to the DC reference voltage Vcc (e.g., 5 V and 3.3 V). The voltage detection unit 25 senses a voltage V1 in the voltage dividing resistor unit 25*c*, and the voltage V1 has an offset voltage (e.g., 2.5 V) due to the voltage dividing resistor unit 25*c*. It is thus possible to more precisely sense or detect the voltage.

In FIG. 6, the voltage V1 is detected, and the voltage detection unit 25 includes the voltage dividing resistor unit 25*c* and a software or firmware operation means.

Figure 7:
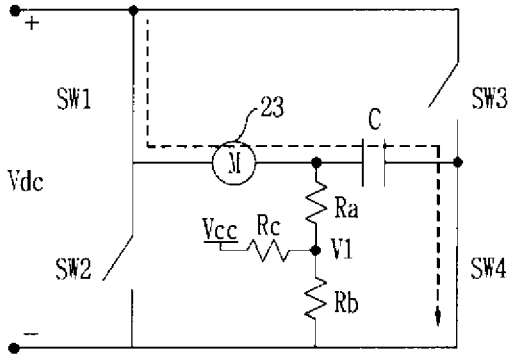
FIGS. 7 and 8 are circuit views illustrating operation of an inverter of FIG. 3.
Figure 8:
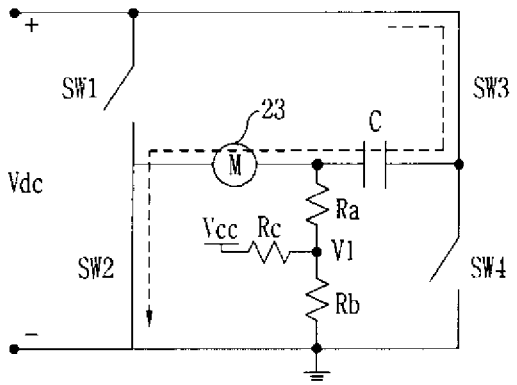

FIGS. 7 and 8 are circuit views illustrating operation of the inverter of FIG. 3.

FIG. 7 illustrates a current flow (a dotted-line arrow) when the circuit of FIG. 6 performs the first operation, and FIG. 8 illustrates a current flow (a dotted-line arrow) when the circuit of FIG. 6 performs the second operation.

In FIG. 7 or FIG. 8, a software or firmware operation means must be provided like the operation of FIG. 5. Since it is substantially difficult to use all the voltages V1 of FIG. 6 as data, a sampled voltage V2 which reflects the voltage V1 is used through a certain sampling time or switching.

In addition, since the relation caused by the voltage dividing resistor unit 25*c* (i.e., a divided voltage and an offset voltage) should be reflected on the voltage Vc' of FIG. 5 and the voltage V1 of FIG. 6, a voltage dividing ratio of the voltage dividing resistor unit 25*c* and/or the offset voltage is considered in the sampled voltage V2, to operate the both-end voltage Vc of the capacitor C.

Figure 9:
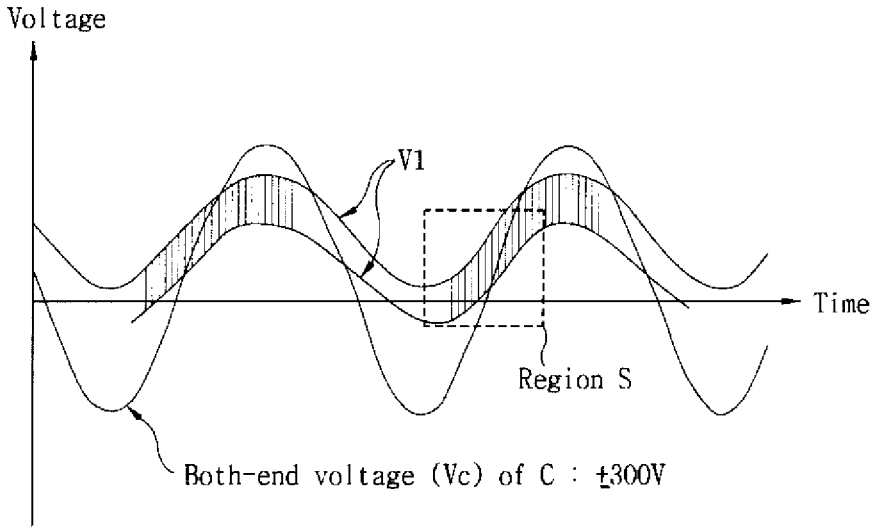
FIGS. 9 to 11 are graphs showing sensed voltages.
Figure 10:
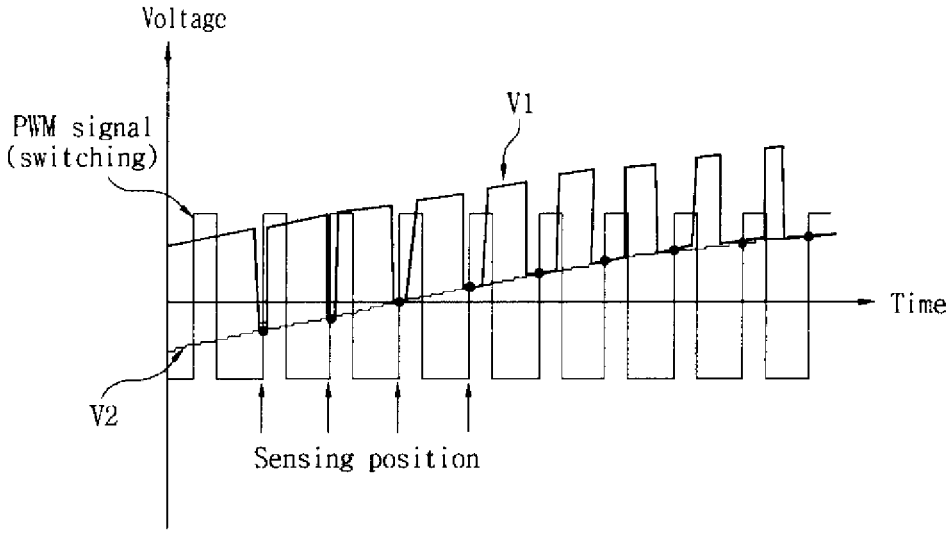
Figure 11:
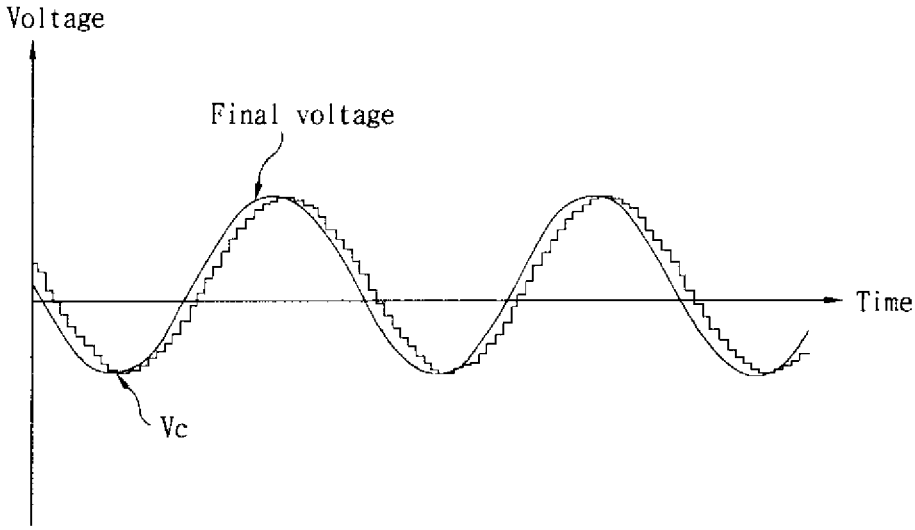

FIGS. 9 to 11 are graphs showing the sensed voltages.

FIG. 9 illustrates the substantial both-end voltage Vc of the capacitor C and the voltage V1.

FIG. 10 enlarges region S of FIG. 9, which illustrates a process for the voltage detection unit 25 sampling the voltage V2 from the detected voltage V1 by a PWM signal (switching). The voltage V2 is sampled in a sensing position corresponding to an edge of the PWM signal. A sampling time (switching time or period) corresponding to the sensing position can be controlled by a control or operation means of the control unit 27. Since this sampling time is closely associated with an amount of data which should be processed by the voltage detection unit 25, the amount of the data to be operated or processed can be adjusted through controlling of the sampling time.

In FIG. 11, the both-end voltage Vc of the capacitor C is compared with a voltage (final voltage) corresponding to the sampled voltage V2 of FIG. 10. The voltage (final voltage) corresponding to the sampled voltage V2 is estimated from the both-end voltage Vc of the capacitor C, considering the voltage dividing ratio of the voltage dividing resistor unit 25 and the offset voltage in the voltage V2. As illustrated in FIG. 11, the voltage (final voltage) operated and estimated from the both-end voltage Vc of the capacitor C through the control apparatus corresponding to FIGS. 6 to 10 is almost identical to the substantial both-end voltage Vc of the capacitor C. The operation unit 26 can operate the counter EMF through the operated and estimated voltage.

The motor control apparatus described above can be applied to not only controlling of a general BLDC motor but also controlling of a linear motor of a compressor, particularly, a linear compressor.

Figure 12:
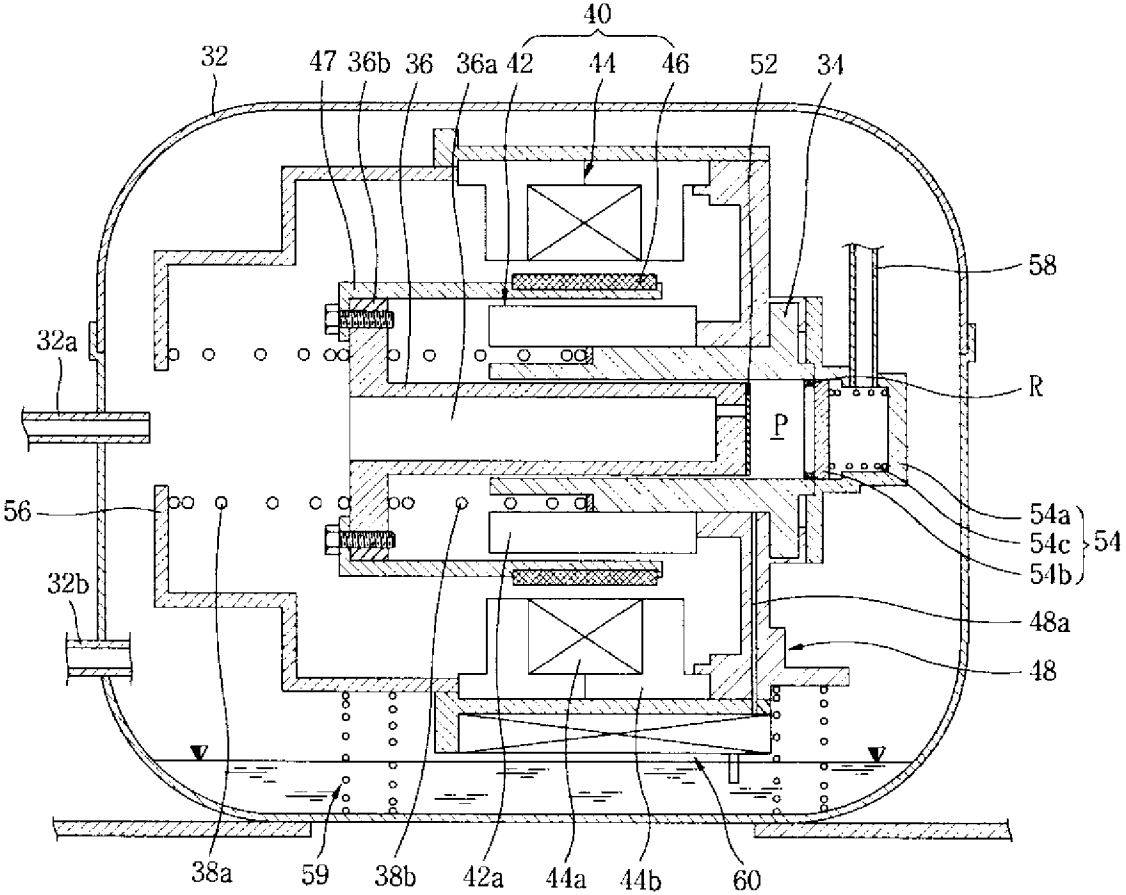
FIG. 12 is a sectional view illustrating the linear compressor according to the present invention.

The motor control apparatus shown in FIG. 3 is applicable to a linear compressor of FIG. 12.

As illustrated in FIG. 12, in the linear compressor according to the present invention, an inlet tube 32*a* and an outlet tube 32*b* through which refrigerant flows in and out are installed at one side of a hermetic container 32, a cylinder 34 is fixedly installed in the hermetic container 32, a piston 36 is installed in the cylinder 34 to linearly reciprocate and compress the refrigerant sucked into a compression space P in the cylinder 34, and various springs are installed to elastically support the piston 36 in a motion direction of the piston 36. The piston 36 is connected to a linear motor 40 which produces a linear reciprocation driving force. Although a natural frequency fn of the piston 36 is varied depending upon a load, the linear motor 40 induces a natural output change which changes a cooling capacity (output) according to the varied load.

Moreover, a suction valve 52 is installed at one end of the piston 36 which is in contact with the compression space P, a discharge valve assembly 54 is installed at one end of the cylinder 34 which is in contact with the compression space P, and the suction valve 52 and the discharge valve assembly 54 are automatically controlled to be opened and closed according to a pressure inside the compression space P, respectively.

Here, the hermetic container 32 is installed such that upper and lower shells are coupled to each other to seal up the inside. The inlet tube 32*a* which introduces the refrigerant and the outlet tube 32*b* which discharges the refrigerant are installed at one side of the hermetic container 32, the piston 36 is elastically supported in the cylinder 34 in the motion direction to linearly reciprocate, and the linear motor 40 is coupled to the outside of the cylinder 34 by a frame 48, thereby constituting an assembly. This assembly is elastically supported on an inner bottom surface of the hermetic container 32 by supporting springs 59.

Further, certain oil is filled in the inner bottom surface of the hermetic container 32, an oil supply apparatus 60 which pumps the oil is installed at a bottom end of the assembly, and an oil supply tube 48*a* is formed in the frame 48 placed at a lower portion of the assembly so as to supply the oil to between the piston 36 and the cylinder 34. Therefore, the oil supply apparatus 60 pumps the oil due to vibration caused by linear reciprocation of the piston 36, so that the oil is supplied to a gap between the piston 36 and the cylinder 34 through the oil supply tube 48*a* for cooling and lubrication.

Next, preferably, the cylinder 34 is formed in a hollow shape so that the piston 36 can linearly reciprocate therein, has the compression space P at one side thereof, and is formed on the same straight line as the inlet tube 32*a* with one end positioned closely to the inside of the inlet tube 32*a*. Surely, the piston 36 is installed in one end of the cylinder 34 near to the inlet tube 32*a* to linearly reciprocate, and the discharge valve assembly 54 is installed at one end of the cylinder 34 opposite to the inlet tube 32*a*.

Here, the discharge valve assembly 54 includes a discharge cover 54*a* installed to define a certain discharge space on one-end side of the cylinder 34, a discharge valve 54*b* installed to open and close one end of the cylinder 34 on the side of the compression space P, and a valve spring 54*c* which is a kind of coil spring applying an elastic force to between the discharge cover 54*a* and the discharge valve 54*b* in an axial direction. An O-ring R is fitted into an inner circumference of one end of the cylinder 34, so that the discharge valve 54*a* is closely attached to the one end of the cylinder 34.

Moreover, a bent loop pipe 58 is connected between one side of the discharge cover 54*a* and the outlet tube 32*b*. The loop pipe 58 not only guides the compressed refrigerant to be discharged to the outside, but also buffers vibration produced by interactions between the cylinder 34, the piston 36 and the linear motor 40, when it is transferred to the overall hermetic container 32.

Accordingly, when the piston 36 linearly reciprocates in the cylinder 34, if a pressure inside the compression space P is over a defined discharge pressure, the valve spring 54*c* is compressed to open the discharge valve 54*b*, so that the refrigerant is discharged from the compression space P, and then completely discharged to the outside through the loop pipe 58 and the outlet tube 32*b*.

Next, a refrigerant passage 36*a* is defined in the center of the piston 36 so that the refrigerant introduced from the inlet tube 32*a* can flow therethrough, the linear motor 40 is connected directly to one end of the piston 36 near to the inlet tube 32*a* by a connection member 47, and the suction valve 52 is installed at one end of the piston 36 opposite to the inlet tube 32*a*. The piston 36 is elastically supported in its motion direction by various springs.

Here, the suction valve 52 is formed in a thin plate shape such that a central portion is partially cut to open and close the refrigerant passage 36*a* of the piston 36 and one side is fixed to one end of the piston 36 by screws.

Therefore, when the piston 36 linearly reciprocates in the cylinder 34, if the pressure of the compression space P is below a defined suction pressure which is lower than a discharge pressure, the suction valve 52 is open, so that the refrigerant is sucked into the compression space P, and if the pressure of the compression space P is over the defined suction pressure, the suction valve 52 is closed and the refrigerant is compressed in the compression space P.

Particularly, the piston 36 is elastically supported in the motion direction. Specifically, a piston flange 36*b* which protrudes in a radius direction from one end of the piston 36 near to the inlet tube 32*a* is elastically supported in the motion direction of the piston 36 by mechanical springs 38*a* and 38*b* such as coil springs, and the refrigerant contained in the compression space P opposite to the inlet tube 32*a* operates as a gas spring due to a own elastic force, thereby elastically supporting the piston 36.

Here, the mechanical springs 38*a* and 38*b* have a constant mechanical spring constant Km regardless of a load. Preferably, the mechanical springs 38*a* and 38*b* are installed respectively on a supporting frame 56 fixed to the linear motor 40 and the cylinder 34 with respect to the piston flange 36*b* to be side by side in an axial direction. Preferably, the mechanical spring 38*a* supported on the supporting frame 56 and the mechanical spring 38*b* installed on the cylinder 34 are constructed to have the same mechanical spring constant Km.

However, the gas spring has a gas spring constant Kg varied dependent on a load. As an ambient temperature rises, a pressure of the refrigerant increases, so that a own elastic force of the gas contained in the compression space P increases. That is, when the load increases, the gas spring constant Kg of the gas spring increases.

At this time, while the mechanical spring constant Km is constant, the gas spring constant Kg is varied dependent on the load. As a result, the entire spring constant is varied dependent on the load, and the natural frequency fn of the piston 36 is varied dependent on the gas spring constant Kg.

Accordingly, while the mechanical spring constant Km and the mass M of the piston 36 are constant in spite of variations of the load, the gas spring constant Kg is varied, so that the natural frequency fn of the piston 36 is considerably influenced by the gas spring constant Kg depending upon the load.

Surely, the load can be measured in various ways. However, since the linear compressor is constructed such that the refrigerant is included in a freezing/air conditioning cycle for compression, condensation, evaporation and expansion, the load can be defined as a difference between a condensation pressure which is a pressure for condensing refrigerant and an evaporation pressure which is a pressure for evaporating refrigerant, and further determined in consideration of an average pressure which is an average of the condensation pressure and the evaporation pressure to improve accuracy.

That is, the load is calculated proportional to the difference between the condensation pressure and the evaporation pressure and the average pressure thereof. The larger the load becomes, the more the gas spring constant Kg increases. For example, when the difference between the condensation pressure and the evaporation pressure is large, the load increases. Although the difference between the condensation pressure and the evaporation pressure is same, if the average pressure increases, the load increases. The gas spring constant Kg increases according to the load. The linear compressor may include a sensor (a pressure sensor, a temperature sensor, etc.) to calculate the load.

Here, measured are a condensation temperature substantially proportional to the condensation pressure and an evaporation temperature substantially proportional to the evaporation pressure. The load is calculated proportional to a difference between the condensation temperature and the evaporation temperature and an average temperature thereof.

In detail, the mechanical spring constant Km and the gas spring constant Kg can be determined through various experiments. A resonance frequency of the piston 36 may be changed in a comparatively-wide range according to a load by increasing the proportion of the gas spring constant Kg to the entire spring constant.

The linear motor 40 includes an inner stator 42 constructed such that a plurality of laminations 42*a* are stacked in a circumferential direction, and fixed to the outside of the cylinder 34 by the frame 48, an outer stator 44 constructed such that a plurality of laminations 44*b* are stacked in a circumferential direction around a coil winding body 44*a* wound with a coil, and installed outside the cylinder 34 by the frame 48 with a defined gap from the inner stator 42, and a permanent magnet 46 positioned in the gap between the inner stator 42 and the outer stator 44, and connected to the piston 36 by the connection member 47. The coil winding body 44*a* may be fixed to the outside of the inner stator 42.

The linear motor 40 corresponds to one embodiment of the motor 23 described above, and the capacitor C is connected in series to the coil winding body 44*a*.

As set forth herein, the control unit 27 calculates the counter EMF and controls the inverter unit 22 according to the counter EMF. Here, the control unit 27 not only prevents an output change caused by variations of external power having variability by applying an AC voltage of a constant amplitude and frequency to the motor 23 (i.e., the linear motor 40), but also brings the natural output change described above by automatically regulating a reciprocation stroke distance of the piston 36 according to a load (e.g., low load, mid-load, high load, over-load, etc.). That is, such a natural output change is accomplished when the reciprocation stroke distance of the piston 36 in the low load is different from the reciprocation stroke distance of the piston 36 in the over-load. In particular, preferably, the piston 36 linearly reciprocates to a Top Dead Center (TDC) in the over-load. When the control unit 27 maintains the amplitude and frequency of the voltage to be constant, although it controls the inverter unit 22 precisely, the amplitude and frequency of the voltage applied to the motor 23 may be varied due to various factors such as noise in the inverter unit 22 or a resistance in a conductive line between the inverter unit 22 and the motor 23. However, with respect to variations of the amplitude and frequency of the voltage, for example, when the amplitude of the voltage varies within ±2% or the frequency of the voltage varies within ±1%, it seldom affects the natural output change. In this case, the voltage should be deemed to have a constant amplitude and frequency. Therefore, in this description, it should be understood that the voltage applied to the motor 23 has a substantially constant amplitude and frequency.

In addition, the capacitor C is a component which determines the circuit operating frequency fc of the motor control apparatus with the coil winding body 44*a*. Here, the size of each of the capacitor C and the coil winding body 44*a* must be designed so that the operating frequency fc can be identical to the natural frequency fn in the maximum output (e.g., in the over-load) of the linear motor 40 (i.e., a resonance point design). The natural frequency fn is estimated in advance and used by considering both the mechanical spring constant Km and the gas spring constant Kg, or decreasing the mechanical spring constant Km and increasing the influence of the gas spring constant Kg on the natural frequency fn. In this design, in a load requiring the maximum output, the piston 36 of the linear motor 40 reciprocates to the TDC, and in a load below the maximum output, the piston 36 of the linear motor 40 reciprocates according to the load. In other words, the natural output change is performed according to the load.

FIGS. 13 to 16 are graphs showing cooling capacities of the linear compressor of FIG. 12.

FIG. 13 shows a case where the inverter unit 22 applies an AC voltage having a specific amplitude and frequency to the motor 23 in the linear compressor of FIG. 12. That is, FIG. 13 is a graph showing a cooling capacity when the specific amplitude and frequency are fixedly maintained (when a substantially-constant amplitude and frequency are maintained).

The above-described automatic output change (i.e., the natural cooling capacity modulation) can be clearly recognized in the cooling capacity graph of FIG. 13. That is, the cooling capacity graph shows that the cooling capacity is changed according to a load (a temperature, an ambient temperature, etc.) (i.e., a load of a refrigerator), and that the cooling capacity has an almost constant magnitude after 40□ (e.g., an over-load region). Moreover, as described above, the piston 36 reciprocates to the TDC after 40□, and reciprocates within a reciprocation stroke distance corresponding to the load below 40□. Besides the automatic output change (i.e., the natural cooling capacity modulation), since the AC voltage having the constant amplitude and frequency is always applied to the linear motor 40 in spite of variations of external power, as shown in FIG. 13, the cooling capacity by the control apparatus according to the present invention is slowly changed, so that a cooling cycle is stably driven. Further, besides the automatic output change and the stable cooling cycle, since the circuit operating frequency fc of the motor control apparatus is identical to the natural frequency fn in the maximum output, the piston 36 reciprocates to the TDC in the maximum output, to thereby maximize cooling efficiency.

FIG. 14 is a graph showing cooling capacities of the linear compressor of FIG. 12. FIG. 14 shows a case where the control unit 27 controls the inverter unit 22 to apply AC voltages having three or more characteristics (voltage amplitudes or frequencies which are plural different values) to the motor 23. That is, the control unit 27 can perform a natural cooling capacity modulation control corresponding to the graph (line I) showing a cooling capacity by an AC voltage having an intermediate cooling capacity, and perform a natural cooling capacity modulation control corresponding to the graph (line II) showing a cooling capacity by an AC voltage having a higher amplitude than the AC voltage corresponding to line I. In addition, the control unit 27 can perform a natural cooling capacity modulation control corresponding to the graph (line III) showing a cooling capacity by an AC voltage having a lower amplitude than the AC voltage corresponding to line I.

As illustrated in FIG. 14, the control unit 27 varies the AC voltage applied to the motor 23 by the inverter unit 22, and maintains the AC voltage to be constant. Here, the control unit 27 performs a forcible cooling capacity modulation control by varying the AC voltage, and performs a natural cooling capacity modulation control corresponding to the varied AC voltage by maintaining the varied AC voltage to be constant. That is, the control unit 27 basically performs the natural cooling capacity modulation control, and can perform the forcible cooling capacity modulation control according to the necessity of the cooling capacity. Specifically, the forcible cooling capacity modulation control may be required according to a load when a cooling capacity over a cooling capacity which can be obtained by the natural cooling capacity modulation control is necessary, or may be required by a user's cooling control command (increase of the cooling capacity, decrease of the cooling capacity, etc.) (e.g., a special cooling command, a low cooling command, etc.).

Figure 15:
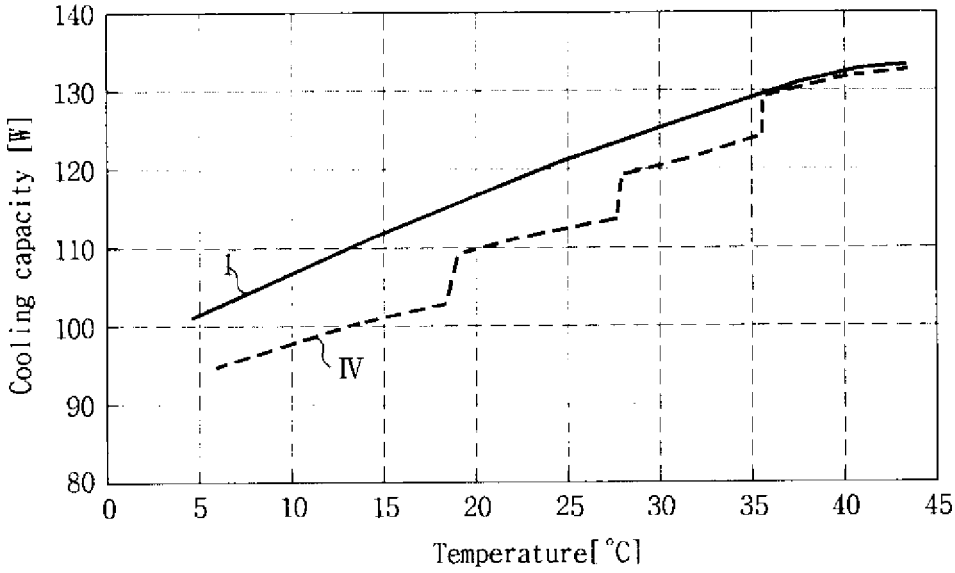

FIG. 15 is a graph showing cooling capacities of the linear compressor of FIG. 12. FIG. 15 shows line I of FIG. 14, and line IV which simultaneously or selectively performs a natural cooling capacity modulation control and a forcible cooling capacity modulation control by gradually increasing the AC voltage corresponding to line III.

For example, according to line IV, when a temperature is below about 18□, the control unit 27 performs only the natural cooling capacity modulation control, and when the temperature ranges from about 18 to 19□, the control unit 27 performs the forcible cooling capacity modulation control which applies a larger AC voltage to forcibly increase a cooling capacity. While performing the forcible cooling capacity modulation control, the control unit 27 can simultaneously or selectively perform the natural cooling capacity modulation control. Moreover, in a section where an amplitude and frequency of the AC voltage increased by the forcible cooling capacity modulation control are maintained to be constant, i.e., between 19 and 27□, the control unit 27 controls the inverter unit 22 to perform the natural cooling capacity modulation control. That is, the control unit 27 performs the natural cooling capacity modulation control and the forcible cooling capacity modulation control according to the necessity of cooling or the load.

Figure 1:
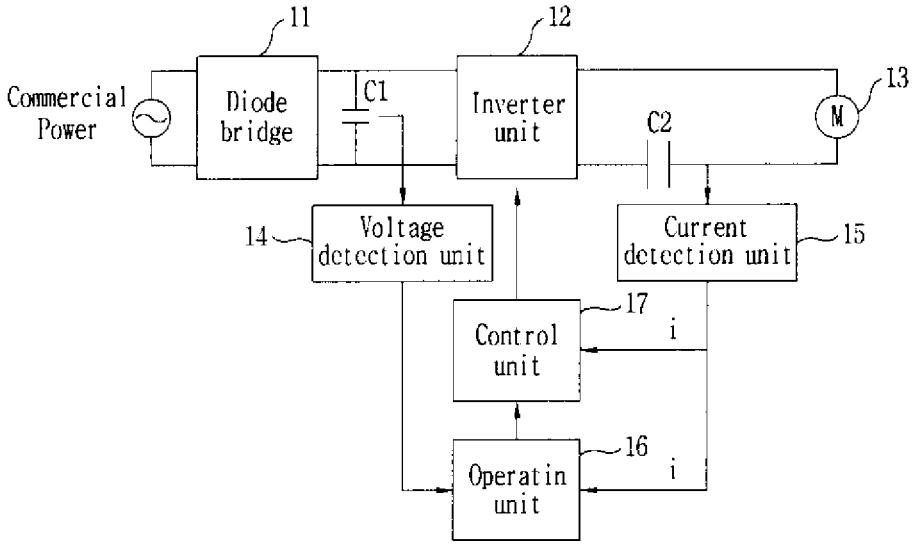
FIG. 1 is a block diagram illustrating construction of a motor control apparatus applied to a conventional linear compressor.
Figure 2:
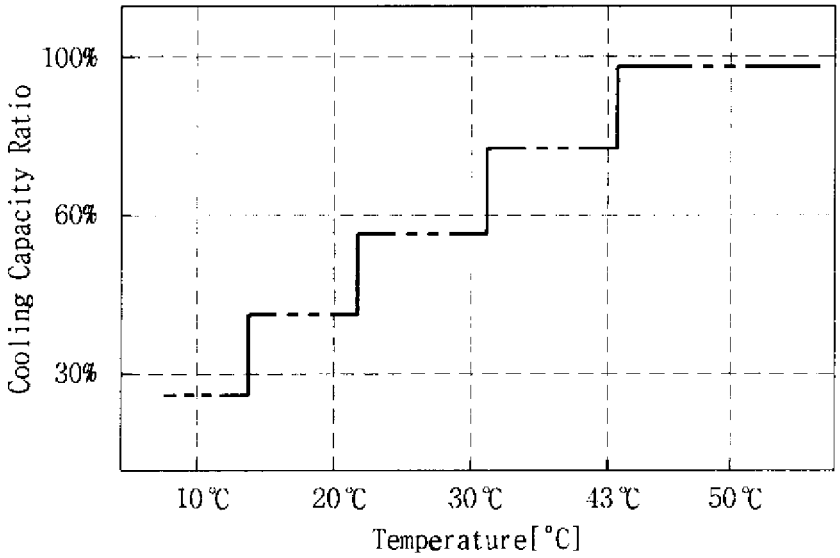
FIG. 2 is a graph showing cooling capacity modulations of the linear compressor of FIG. 1.
Figure 16:
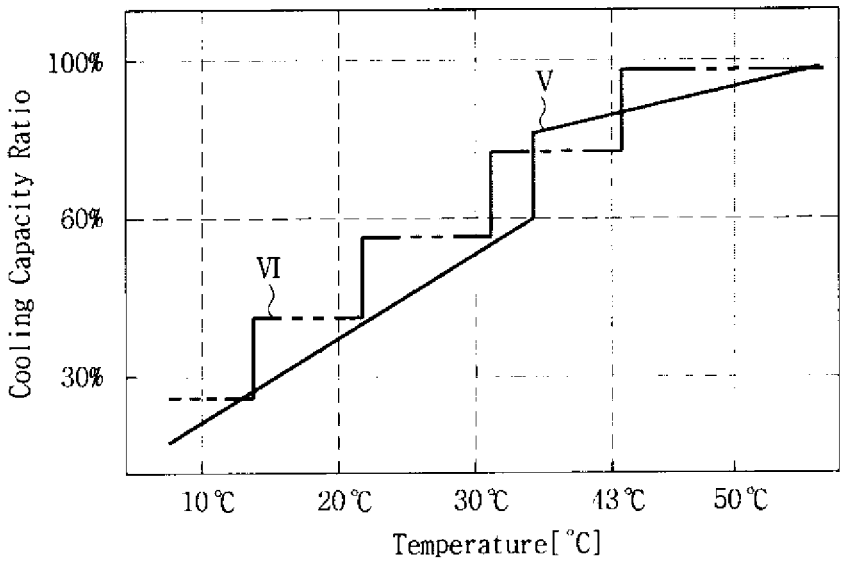

FIG. 16 is a graph showing a cooling capacity of the linear compressor of FIG. 12. Particularly, FIG. 16 shows a cooling capacity graph (line VI) of a conventional linear compressor (i.e., the graph of FIG. 2), and a cooling capacity graph (line V) of the linear compressor of FIG. 12.

As shown, in the graph VI of the prior art, only a forcible cooling capacity modulation control can be performed to increase a cooling capacity ratio according to a load, so that an AC voltage applied to the motor must be increased step by step. Accordingly, since a cooling capacity is modulated merely by the forcible cooling capacity modulation control, it is necessary to repeatedly perform the forcible cooling capacity modulation control a few times.

On the contrary, in the graph V of the present invention, only a natural cooling capacity modulation control is performed till a certain cooling capacity ratio (e.g., 60%), a forcible cooling capacity modulation control and the natural cooling capacity modulation control are simultaneously or selectively performed to increase a cooling capacity while the cooling capacity ratio ranges from 60 to 75%, and only the natural cooling capacity modulation control is performed to obtain a necessary cooling capacity when the cooling capacity ratio is over 75%. That is, a target cooling capacity ratio or cooling capacity can be obtained, minimizing the forcible cooling capacity modulation control.

Figure 17:
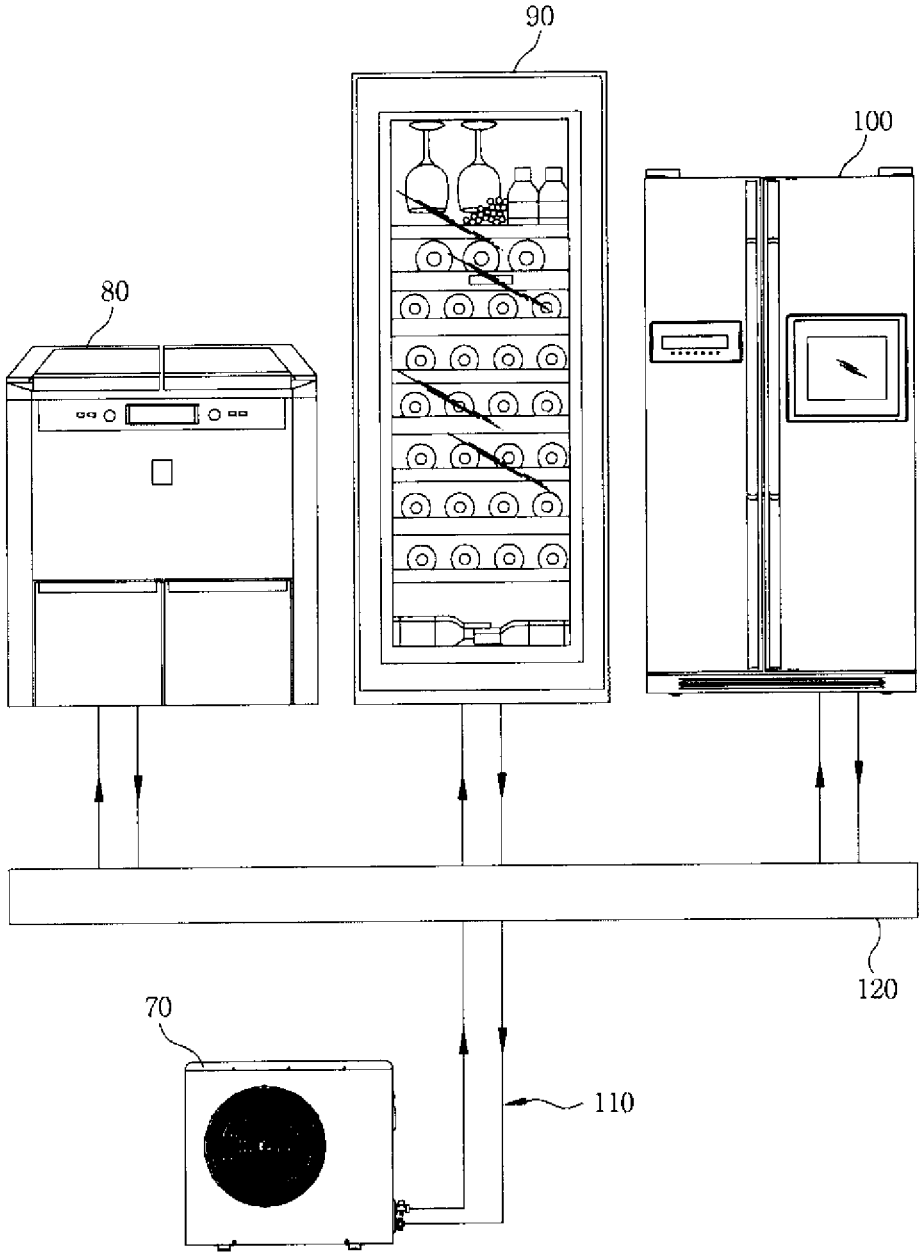
FIG. 17 is a view illustrating one example of a cooling system adopting the linear compressor of FIG. 3.

FIG. 17 is a view illustrating one example of a cooling system adopting the linear compressor of FIG. 3. The cooling system (or complex cooling system) includes one outdoor unit 70, and a Kimchi refrigerator 80, a wine refrigerator 90 and a refrigerator 100 which are cooling apparatuses, and refrigerant is circulated between the outdoor unit 70, and the Kimchi refrigerator 80, the wine refrigerator 90 and the refrigerator 100 through a refrigerant tube 110 and a tube connection portion 120. Here, it should be understood that the cooling apparatuses include an apparatus for cooling such as an air conditioner as well as such freezing and refrigerating apparatuses.

Figure 18:
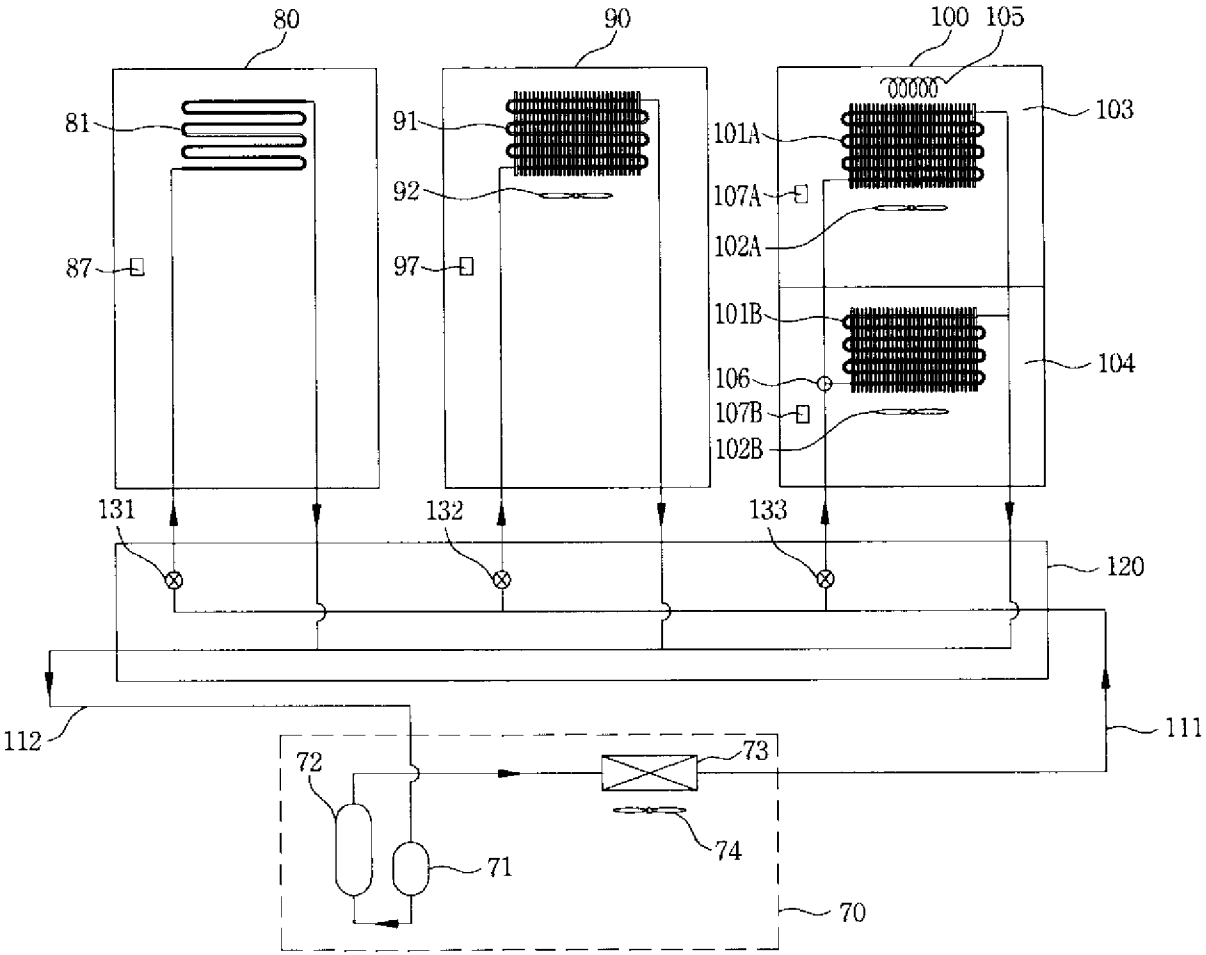
FIG. 18 is a construction view illustrating one example of a freezing cycle constituting the cooling system according to the present invention.

FIG. 18 is a construction view illustrating one example of a freezing cycle constituting the cooling system according to the present invention.

The outdoor unit 70 includes an accumulator 71, a linear compressor 72 of FIG. 12, and a condenser 73 according to flow of refrigerant. The condenser 73 may further include a fan 74, and the accumulator 71 enables gas-phase refrigerant to enter the linear compressor 72. The refrigerant discharged from the condenser 73 is introduced into the tube connection portion 120 through a supply refrigerant tube 111, and supplied to one of the Kimchi refrigerator 80, the wine refrigerator 90 and the refrigerator 100 through the tube connection portion 120. This supplying process is controlled by valves 131, 132 and 133. The refrigerant passing through one of the Kimchi refrigerator 80, the wine refrigerator 90 and the refrigerator 100 is collected in the accumulator 71 via a collection refrigerant tube 112 and the tube connection portion 120. The tube connection portion 120 may be actually provided, or may be understood as a virtual space in which the supply refrigerant tube 111, the collection refrigerant tube 112 and/or the valves 131, 132 and 133 are positioned, and may be located on the side of the outdoor unit 70. Meanwhile, the valves 131, 132 and 133 may be positioned on the side of the outdoor unit 70 and/or the refrigerators according to a control unit (not shown) which controls the valves 131, 132 and 133. The Kimchi refrigerator 80, the wine refrigerator 90 and the refrigerator 100 are connected respectively to the outdoor unit 70 through the supply refrigerant tube 111 and the collection refrigerant tube 112. The Kimchi refrigerator 80 includes an evaporator 81, the wine refrigerator 90 includes an evaporator 91 and a fan 92, and the refrigerator 100 includes evaporators 101A and 101B and fans 102A and 102B. The refrigerator 100 includes a freezing chamber 103 and a refrigerating chamber 104, the evaporator 101A is used for freezing of the freezing chamber 103, and the evaporator 101B is used for refrigerating of the refrigerating chamber 104. In addition, the refrigerator 100 includes a heater 105 for defrosting of the freezing chamber 103, and a valve 106 which controls supply of the refrigerant to the freezing chamber 103 and the refrigerating chamber 104. It is obvious to a person of ordinary skill in the art that the present invention is not limited to the Kimchi refrigerator, the wine refrigerator and the refrigerator provided with the freezing chamber and the refrigerating chamber, but applied to any apparatus for refrigerating or freezing without departing from the basic scope thereof. Moreover, the Kimchi refrigerator 80, the wine refrigerator 90 and the refrigerator 100 include temperature sensors 87, 97, 107A and 107B for measuring a temperature, respectively. In the meantime, a control unit (not shown) which controls operations of the outdoor unit 70, the Kimchi refrigerator 80, the wine refrigerator 90 and the refrigerator 100, and a cable (not shown) for use in transmitting and receiving signals between them are further provided. The control unit may be provided in each of the refrigerators and the outdoor unit, or any one or at least one of them. Various modifications of the construction and operation of the control unit are shown in an air conditioning system provided with one outdoor unit and a plurality of indoor units. The temperature sensors 87, 97, 107A and 107B are normally positioned in the refrigerators, but may be positioned on the evaporators, or in the refrigerators and on the evaporators.

The linear compressor 72 is implemented with the linear compressor of FIGS. 3 and 12, and performs a natural cooling capacity modulation control and a forcible cooling capacity modulation control. Further, the linear compressor 72 may be constructed in a plural number.

Next, the operation of the freezing cycle shown in FIG. 18 will be explained. In order to cool the freezing chamber 103, the linear compressor 72 is operated, and the refrigerant is supplied to the evaporator 101A via the condenser 73 and the supply refrigerant tube 111, and circulated to the linear compressor 72 via the collection refrigerant tube 112 and the accumulator 71. Here, the valve 133 is opened, the valves 131 and 132 are closed, and the valve 106 is operated to make the refrigerant flow toward the evaporator 101A. The fan 107A and the fan 74 can operate together. When a temperature measured by the temperature sensor 107A is below a set valve (e.g., −18□), supply of the refrigerant to the evaporator 101A is stopped.

So as to cool the refrigerating chamber 104, the valve 106 is operated to make the refrigerant flow toward the evaporator 101B. When a temperature measured by the temperature sensor 107B is below a set valve (e.g., 3□), supply of the refrigerant to the evaporator 101B is stopped.

In the case of cooling of the refrigerator 100, the linear compressor 72 obtains a cooling capacity corresponding to a load through the natural cooling capacity modulation control, based on the temperatures (i.e., the loads) measured by the temperature sensors 107A and 107B.

Meanwhile, when the refrigerator 100, the Kimchi refrigerator 90 and the wine refrigerator 80 need to be cooled, respectively, the linear compressor 72 can supply a necessary cooling capacity merely by the natural cooling capacity modulation control.

Cooling of each refrigerator can be sequentially performed as described above. However, when cooling of the plurality of refrigerators is requested (i.e., when a cooling capacity much higher than a previously-needed cooling capacity is requested) (i.e., when a deviation of the cooling capacities is large), if temperatures inside the refrigerators measured by the temperature sensors 87, 97, 107A and 107B are over preset values, the linear compressor 72 receives cooling control commands from cooling control apparatuses (e.g., control apparatuses and main control units of the refrigerators) installed in the respective refrigerators or a cooling control apparatus which manages the overall cooling system, and performs a forcible cooling capacity modulation control, to thereby obtain a cooling capacity which cannot be obtained by the natural cooling capacity modulation control.

Figure 19:
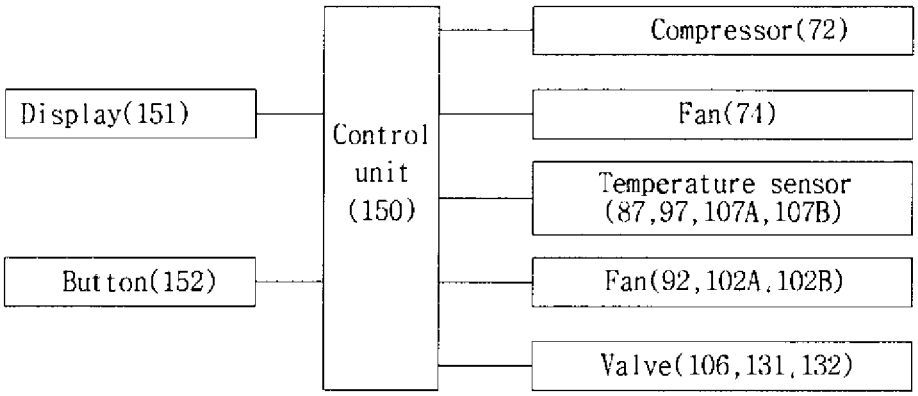
FIG. 19 is a block diagram illustrating one example of the cooling system according to the present invention.

FIG. 19 is a block diagram illustrating one example of the cooling system according to the present invention.

A control unit 150 interworks with the linear compressor 72, the fan 74, the temperature sensors 87, 97, 107A and 107B, the fans 32, 42A and 42B, and the valves 106, 131, 132 and 133 to operate the cooling system. The control unit 150 can receive input of a cooling control command (e.g., a special cooling command, a low cooling command, etc.) through a user's manipulation of a button 152 (i.e., an input means), or generate a cooling control command corresponding to a sensed temperature from the temperature sensor, and transmit the command to the linear compressor 72. The control unit 150 may correspond to the cooling control apparatuses provided in the respective refrigerators 80, 90 and 100 of FIG. 18, or may be an apparatus which communicates with the linear compressor 72 independently from the cooling control apparatuses and transmits a cooling control command thereto.

The present invention has been described in detail with reference to the embodiments and the attached drawings. However, the scope of the present invention is not limited to the embodiments and the drawings, but defined by the appended claims.

The invention claimed is:

1. A linear compressor, comprising:

a compression space into which refrigerant is sucked;

a movable member which linearly reciprocates to compress the refrigerant sucked into the compression space;

one or more springs which are installed to elastically support the movable member in a motion direction of the movable member;

a motor unit which includes a motor and a capacitor connected in series to the motor so as to make the movable member linearly reciprocate; and a motor control unit which performs a natural cooling capacity modulation according to a load by reciprocation of the movable member, wherein the motor control unit performs a forcible cooling capacity modulation by varying an amplitude or frequency of a voltage applied to the motor unit, and wherein the motor control unit performs the forcible cooling capacity modulation by varying the amplitude or frequency of the voltage applied to the motor unit into plural values, and then performs the natural cooling capacity modulation by maintaining the amplitude or frequency of the varied voltage to be constant, and applying the maintained voltage to the motor unit.

2. The linear compressor of claim 1, wherein the motor control unit performs the natural cooling capacity modulation by maintaining an amplitude and frequency of a voltage applied to the motor unit to be substantially constant.

3. A linear compressor, comprising:

a compression space into which refrigerant is sucked;

a movable member which linearly reciprocates to compress the refrigerant sucked into the compression space;

one or more springs which are installed to elastically support the movable member in a motion direction of the movable member;

a motor unit which includes a motor and a capacitor connected in series to the motor so as to make the movable member linearly reciprocate; and a motor control unit which performs a natural cooling capacity modulation according to a refrigerant change by varying a stroke of the movable member, wherein the motor control unit performs a forcible cooling capacity modulation by varying an amplitude or frequency of a voltage applied to the motor unit, and wherein the motor control unit performs the forcible cooling capacity modulation by varying the amplitude or frequency of the voltage applied to the motor unit into plural values, and then performs the natural cooling capacity modulation by maintaining the amplitude or frequency of the varied voltage to be constant, and applying the maintained voltage to the motor unit.

4. The linear compressor of claim 3, wherein the motor control unit performs the natural cooling capacity modulation by maintaining an amplitude and frequency of a voltage applied to the motor unit to be substantially constant.

5. The linear compressor of claim 3, wherein the motor control unit senses a voltage corresponding to commercial power applied from the outside or power applied to the motor unit, and controls the motor unit according to the sensed voltage.

6. The linear compressor of either claim 1 or 3, wherein the motor control unit varies the amplitude or frequency of the voltage according to a cooling capacity modulation command from a cooling control apparatus.

7. A linear compressor comprising:

a compression space into which refrigerant is sucked;

a movable member which linearly reciprocates to compress the refrigerant sucked into the compression space;

one or more springs which are installed to elastically support the movable member in a motion direction of the movable member;

a motor unit which includes a motor and a capacitor connected in series to the motor so as to make the movable member linearly reciprocate; and a motor control unit which performs a natural cooling capacity modulation according to a refrigerant change by varying a stroke of the movable member, wherein the motor control unit comprises a rectification unit which receives input of AC power and outputs a DC voltage, an inverter unit which receives the DC voltage, converts the DC voltage into an AC voltage according to a control signal, and supplies the AC voltage to the motor unit, a first voltage detection unit which senses a voltage applied to the inverter unit, a second voltage detection unit which senses a voltage corresponding to a voltage between a capacitor and the ground, and an inverter control unit which receives a first voltage from the first voltage detection unit and a second voltage from the second voltage detection unit, generates a control signal for controlling the inverter unit to maintain an amplitude and frequency of the AC voltage to be substantially constant according to the first and second voltages, and applies the control signal to the inverter unit.

8. The linear compressor of claim 7, wherein the inverter control unit regulates a sampling time of the second voltage detection unit which detects the second voltage.

9. The linear compressor of claim 7, wherein the inverter control unit calculates a counter EMF corresponding to the first and second voltages, and generates a control signal according to the calculated counter EMF.

10. A cooling system, comprising:

one or more cooling apparatuses;

a compressor which is connected to one of the cooling apparatuses to supply refrigerant thereto, and performs a natural cooling capacity modulation control for naturally varying a cooling capacity according to a load, and a forcible cooling capacity modulation control for forcibly modulating a cooling capacity according to a load or a cooling control command so as to supply refrigerant to the cooling apparatus; and a refrigerant tube which connects the cooling apparatus to the compressor, wherein the compressor comprises a compression space into which refrigerant is sucked, a movable member which linearly reciprocates to compress the refrigerant sucked into the compression space, one or more springs which are installed to elastically support the movable member in a motion direction of the movable member, a motor unit which includes a motor and a capacitor connected in series to the motor so as to make the movable member linearly reciprocate, and a motor control unit which performs the natural cooling capacity modulation control by maintaining an amplitude and frequency of a voltage applied to the motor unit to be substantially constant, and performs the forcible cooling capacity modulation control by varying the amplitude or frequency of the applied voltage, and wherein the motor control unit performs the forcible cooling capacity modulation by varying the amplitude or frequency of the voltage applied to the motor unit into plural values, and then performs the natural cooling capacity modulation by maintaining the amplitude or frequency of the varied voltage to be constant, and applying the maintained voltage to the motor unit.

11. The cooling system of claim 10, wherein the compressor selectively performs the natural cooling capacity modulation control and the forcible cooling capacity modulation control.

12. The cooling system of claim 10, wherein the cooling apparatus receives input of a cooling control command from a user, or generates a cooling control command corresponding to necessity of cooling for a cooling space defined therein, and transmits the cooling control command to the compressor.

13. A cooling system, comprising:

one or more cooling apparatuses;

a compressor which is connected to one of the cooling apparatuses to supply refrigerant thereto, and performs only a natural cooling capacity modulation control for naturally modulating a cooling capacity according to a load so as to supply the refrigerant to the cooling apparatus; and refrigerant tube which connects the cooling apparatus to the compressor, wherein the compressor comprises a compression space into which refrigerant is sucked, a movable member which linearly reciprocates to compress the refrigerant sucked into the compression space, one or more springs which are installed to elastically support the movable member in a motion direction of the movable member, a motor unit which includes a motor and a capacitor connected in series to the motor so as to make the movable member linearly reciprocate, and a motor control unit which performs the natural cooling capacity modulation control by maintaining an amplitude and frequency of a voltage applied to the motor unit to be substantially constant, and wherein the motor control unit senses a voltage corresponding to commercial power applied from the outside or power applied to the motor unit, and controls the motor unit according to the sensed voltage.

14. The cooling system of claim 13, wherein the motor control unit performs a forcible cooling capacity modulation by varying an amplitude or frequency of a voltage applied to the motor unit.

15. The cooling system of claim 14, wherein the motor control unit performs the forcible cooling capacity modulation by varying the amplitude or frequency of the voltage applied to the motor unit into plural values, and then performs the natural cooling capacity modulation by maintaining the amplitude or frequency of the varied voltage to be constant, and applying the maintained voltage to the motor unit.

16. A motor control unit for controlling a motor unit comprising a motor and a capacitor connected in series to the motor in a cooling system, the motor control unit comprising:

a rectification unit which receives input of AC power and outputs a DC voltage;

an inverter unit which receives the DC voltage, converts the DC voltage into an AC voltage according to a control signal, and supplies the AC voltage to the motor unit;

a first voltage detection unit which senses a voltage applied to the inverter unit;

a second voltage detection unit which senses a voltage corresponding to a voltage between a capacitor and the ground; and a control unit which receives a first voltage from the first voltage detection unit and a second voltage from the second voltage detection unit, generates a control signal for controlling the inverter unit to maintain an amplitude and frequency of the AC voltage to be substantially constant according to the first and second voltages, and applies the control signal to the inverter unit.

17. The motor control unit of claim 16, wherein the control unit regulates a sampling time of the second voltage detection unit which detects the second voltage.

18. The motor control unit of claim 16, wherein the control unit calculates a counter EMF corresponding to the first and second voltages, and generates a control signal according to the calculated counter EMF.

19. A cooling capacity modulation controlling method for a cooling system comprising one or more cooling apparatuses, a compressor which is connected to one of the cooling apparatuses to supply refrigerant thereto, and a refrigerant tube which connects the cooling apparatus to the compressor, the method comprising:

a first step for performing a forcible cooling capacity modulation for forcibly modulating cooling capacity based on a cooling capacity ratio range; and a second step for maintaining a controlling condition during the first step for performing a forcible cooling capacity modulation and performing a natural cooling capacity modulation for naturally modulating cooling capacity.

20. The cooling capacity modulation controlling method of claim 19, wherein the method further comprises a third step for only performing the natural cooling capacity modulation when the cooling capacity ratio range is below a first cooling capacity ratio range, the first step for performing a forcible cooling capacity modulation is carried out when the cooling capacity ratio range is included in a second cooling capacity ratio range above the first cooling capacity ratio range.

21. The cooling capacity modulation controlling method of claim 20, wherein the second step for maintaining a controlling condition is carried out when the cooling capacity ratio range is included in a third cooling capacity ratio range above the second cooling capacity ratio range.

22. The cooling capacity modulation controlling method of claim 19, wherein the controlling condition includes an amplitude and frequency of a varied voltage applied to a motor installed in the compressor.

* * * * *